US006652346B1

(12) United States Patent
Arnold, III

(10) Patent No.: US 6,652,346 B1
(45) Date of Patent: Nov. 25, 2003

(54) MUSICAL BOTTLE SYSTEM

(76) Inventor: Cleveland N. Arnold, III, 4323 Arch St., Tampa, FL (US) 33607

( * ) Notice: Subject to any disclaimer, the term of this patent is extended or adjusted under 35 U.S.C. 154(b) by 0 days.

(21) Appl. No.: 10/171,553

(22) Filed: Jun. 14, 2002

(51) Int. Cl.[7] ..... A63H 5/00
(52) U.S. Cl. ..... 446/81; 446/77; 215/11.1
(58) Field of Search ..... 215/11.1, 11.6; 446/81; 40/310, 124.04, 455, 906, 717

(56) References Cited

U.S. PATENT DOCUMENTS

| | | | | | |
|---|---|---|---|---|---|
| 4,678,093 | A | | 7/1987 | Allen | |
| 4,969,564 | A | * | 11/1990 | Cohen et al. | 215/11.1 |
| 4,994,076 | A | * | 2/1991 | Guss | 606/236 |
| 5,105,956 | A | * | 4/1992 | Tarng-Lin | 215/11.1 |
| 5,344,034 | A | * | 9/1994 | Eagan | 215/11.1 |
| D354,202 | S | | 1/1995 | Smith et al. | |
| 5,404,343 | A | * | 4/1995 | Boggio | 369/19 |
| 5,421,496 | A | * | 6/1995 | Korsinsky et al. | 224/148.2 |
| 5,572,497 | A | | 11/1996 | Kim et al. | |
| 5,664,745 | A | * | 9/1997 | Hadaway | 248/105 |
| 5,794,371 | A | * | 8/1998 | Camillery | 40/717 |
| 5,842,901 | A | * | 12/1998 | Montgomery | 446/77 |
| 5,873,474 | A | | 2/1999 | Gray | |
| 6,024,625 | A | | 2/2000 | Pearce | |

* cited by examiner

*Primary Examiner*—Kien T. Nguyen

(57) ABSTRACT

A musical bottle system for providing a unique baby bottle that would allow parents and other caregivers to play children's songs, nursery rhymes, or verbal recordings to mentally stimulate, educate, or entertain the baby as he is being fed. The musical bottle system includes a main housing assembly that has a bottom wall, a top wall, and a perimeter wall for defining an interior space. A sound reproduction assembly is positioned substantially within the main housing assembly. The sound reproduction assembly is for generating music or vocal signals. A container portion is operationally couplable to the main housing assembly. The container portion is for holding a beverage to be consumed by a user.

6 Claims, 3 Drawing Sheets

MUSICAL BOTTLE SYSTEM

BACKGROUND OF THE INVENTION

1. Field of the Invention

The present invention relates to musical baby bottles and more particularly pertains to a new musical bottle system for providing a unique baby bottle that would allow parents and other caregivers to play children's songs, nursery rhymes, or verbal recordings to mentally stimulate, educate, or entertain the baby is being fed.

2. Description of the Prior Art

The use of musical baby bottles is known in the prior art. U.S. Pat. No. 5,873,474 describes a baby bottle straw which comprises a one piece cap that will attach to a baby bottle and has few parts so it can be easily sterilized. Another type of musical baby bottle is U.S. Pat. No. 5,664,745 describes a musical baby bottle adapter that is releasably attachable to a bottom of a baby bottle. U.S. Pat. No. 4,678,093 describes a musical baby bottle having microchip driven music means. U.S. Patent No. describes a musical baby bottle for playing music and feeding babies. U.S. Pat. No. Des. 354,202 describes a musical bottle holder.

While these devices fulfill their respective, particular objectives and requirements, the need remains for a music bottle system that could be easily adapted to play any tune the user desires.

SUMMARY OF THE INVENTION

The present invention meets the needs presented above by utilizing a sound generating means consisting of a compact disc player, mini disc player, mp3 player, or cassette player.

Another object of the present invention is to provide a new musical bottle system that would provide an entertaining and soothing effect for the child while promoting the developing an understanding and command of language skills and other cognitive skills at an earlier age.

Still another object of the present invention is to provide a new musical bottle system that would feature a unique extended nipple assembly that would allow the parent to feed an infant in a hands free manner.

To this end, the present invention generally comprises a main housing assembly that has a bottom wall, a top wall, and a perimeter wall for defining an interior space. A sound reproduction assembly is positioned substantially within the main housing assembly. The sound reproduction assembly is for generating music or vocal signals. A container portion; is operationally couplable to the main housing assembly. The container portion is for holding a beverage to be consumed by a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
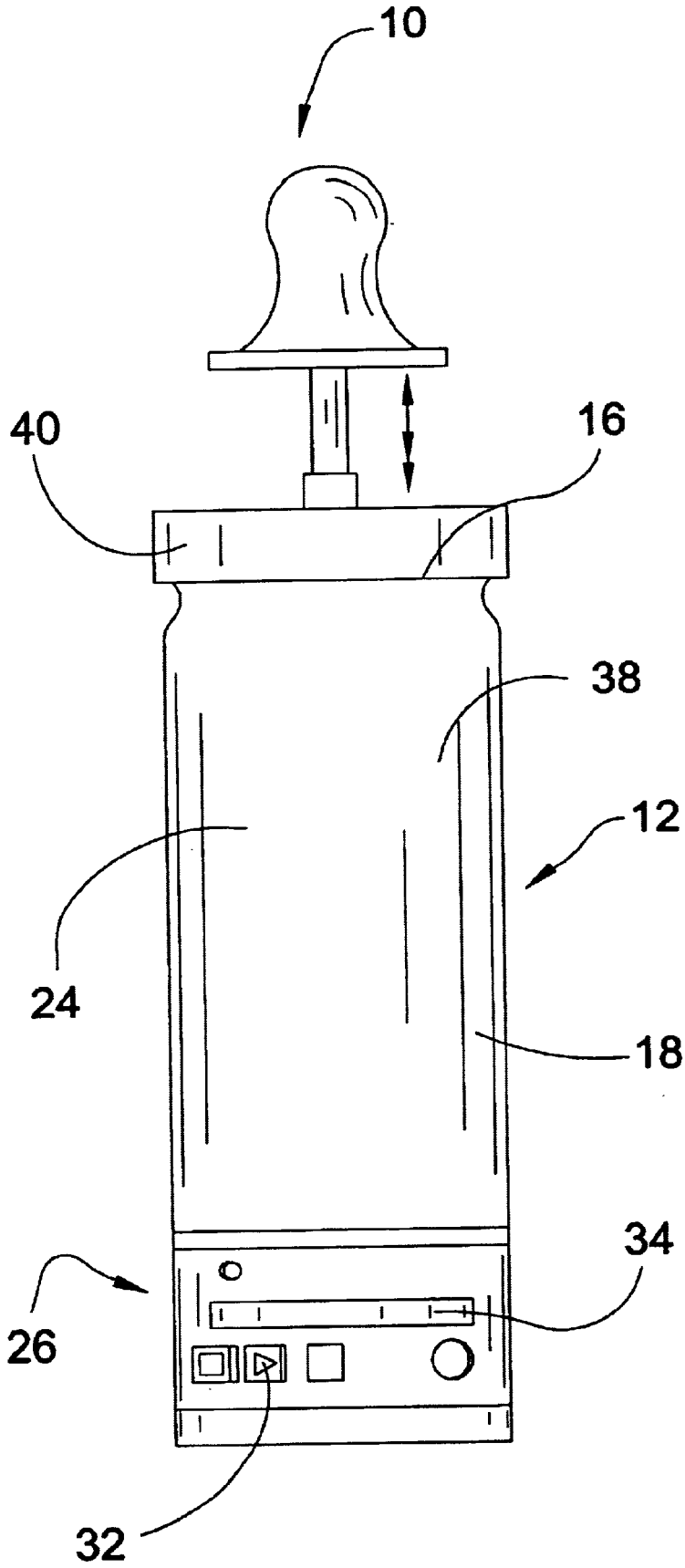
FIG. 1 is a front view of a new musical bottle system according to the present invention.
Figure 2:
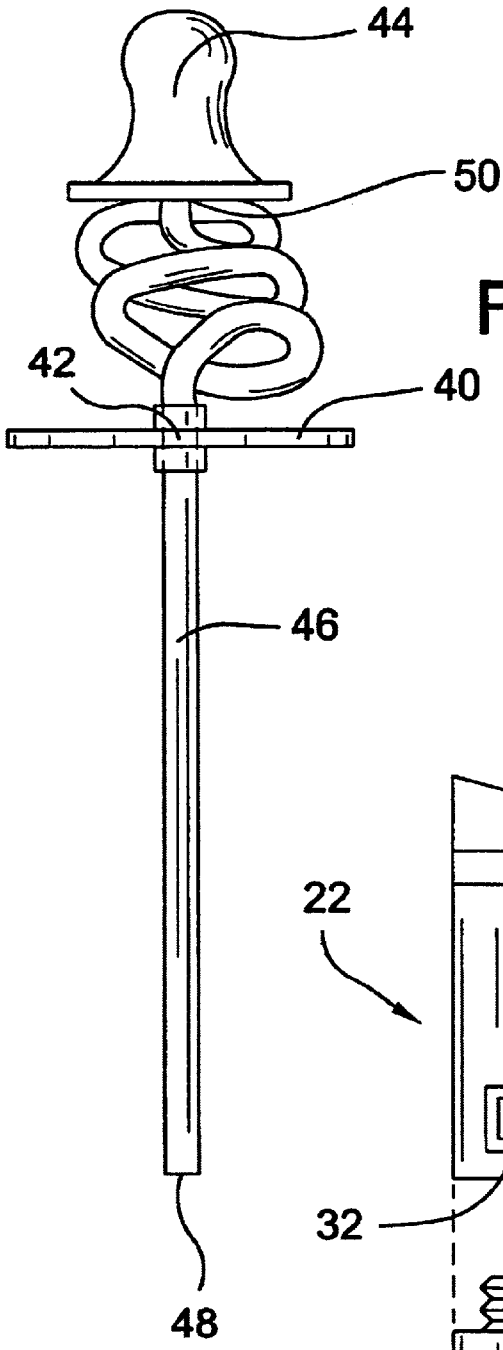
FIG. 2 is a front view of the present invention.
Figure 3:
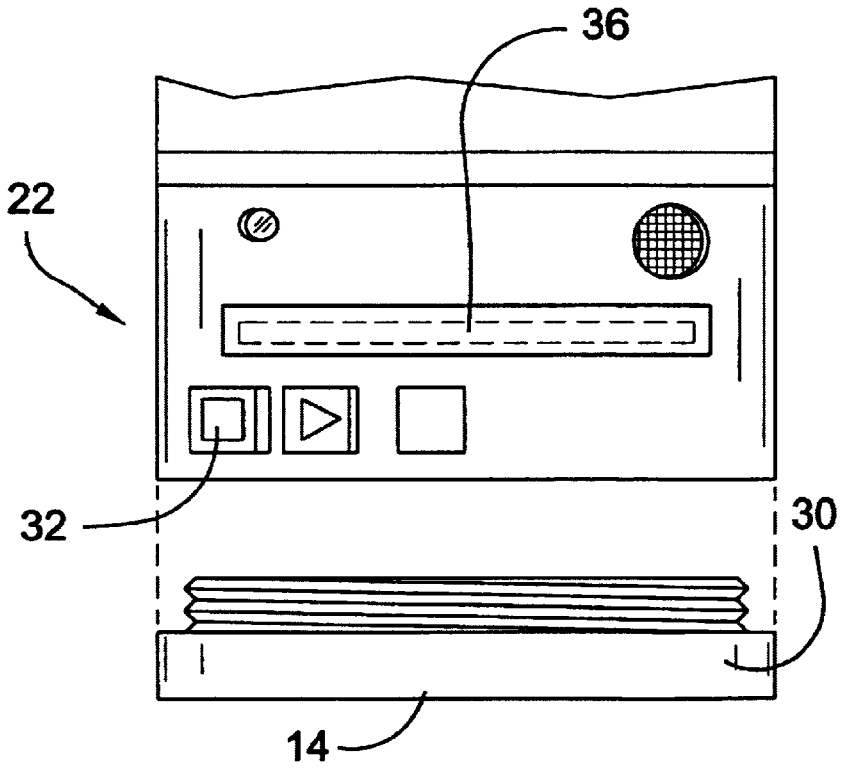
FIG. 3 is a front view of the present invention.
Figure 4:
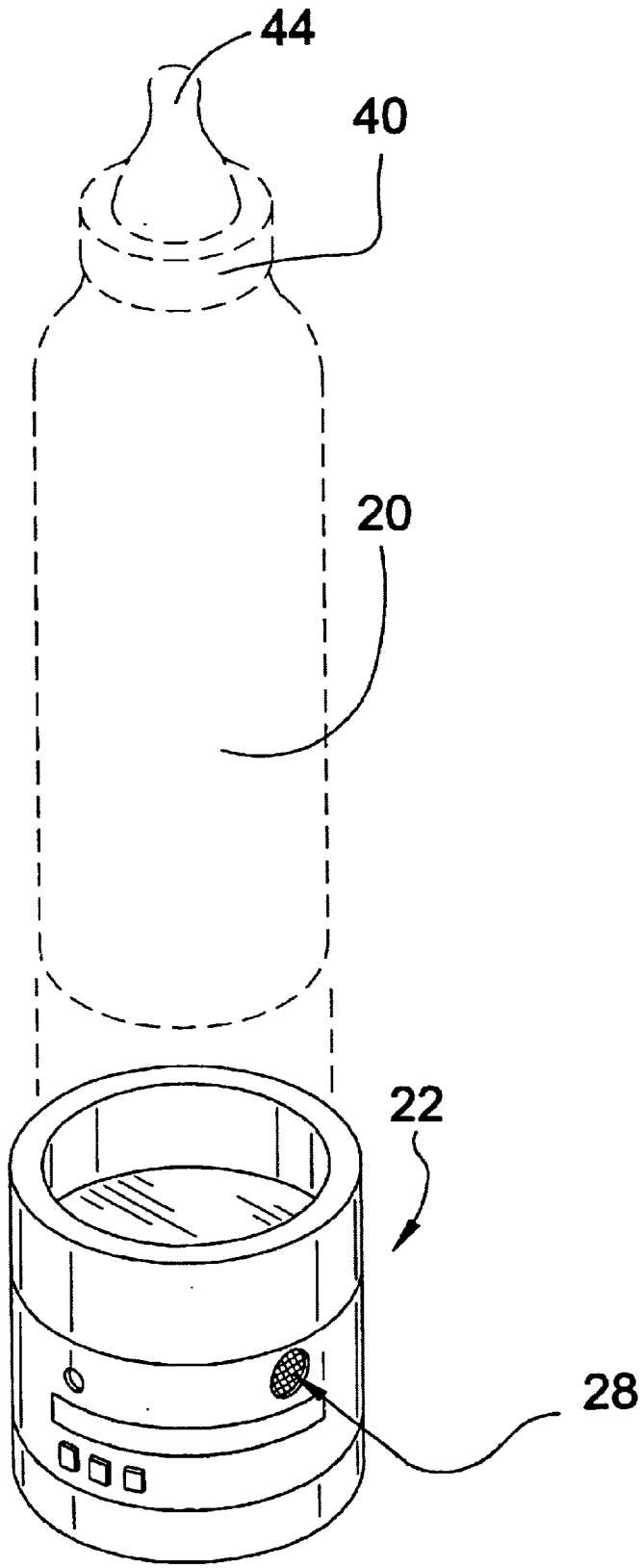
FIG. 4 is a perspective view of the present invention.

With reference now to the drawings, and in particular to FIGS. 1 through 4 thereof, a new musical bottle system embodying the principles and concepts of the present invention and generally designated by the reference numeral 10 will be described.

As best illustrated in FIGS. 1 through 4, the musical bottle system 10 generally comprises a main housing assembly 12 that has a bottom wall 14, a top wall 16, and a perimeter wall 18 for defining an interior space 20. A sound reproduction assembly 22 is positioned substantially within the main housing assembly 12. The sound reproduction assembly 22 is for generating music or vocal signals. A container portion 24 is operationally couplable to the main housing assembly 12. The container portion 24 is for holding a beverage to be consumed by a user.

The sound reproduction assembly 22 further includes a sound generating means 26 for translating media stored information into an electrical signal representation of an audio signal. At least one speaker assembly 28 is for converting the electrical signal representation into sound waves. The speaker assembly 28 is operationally coupled to the sound generating means 26. A battery member 30 is for providing electrical energy to the sound generating means 26. The battery member 30 is operationally coupled to the sound generating means 26. The sound generating means 26 includes a sound generating means 26 selected from the group of sound generating means 26 consisting of compact disc player, mini disc player, mp3 player,; or cassette player.

The main housing assembly 12 is substantially cylindrical. The perimeter wall 18 of the main housing assembly 12 has a first surface. The sound generating means 26 has a plurality of control actuators 32, each one of the control actuators 32 is positioned on the first surface facilitating access by a user. The main housing assembly 12 has a media slot 34 for selectively receiving prerecorded media 36 to be played by the sound generating means 26.

The container portion 24 further includes a main bottle portion 38 adapted for holding a beverage. The main bottle portion 38 has a bottom wall 14 and a bottle perimeter wall 18 that extends upwardly there from. The perimeter wall 18 has a distal end with thread applied thereon. A cap member 40 has a medial aperture 42 that extends therethrough. The cap member 40 is threadably couplable to the main bottle portion 38. A nipple member 44 is operationally couplable to the cap member 40. The nipple member 44 is for facilitating drinking by an infant.

A straw member 46 has a first end 48 positionable substantially within the main bottle portion 38. The straw member 46 has a second end 50 that extends through the medial aperture 42. The straw member 42 is substantially hollow. The nipple member 44 is coupled to the straw member 46, such that the nipple member 44 is in environmental communication with an interior of the main bottle portion 38.

In an preferred embodiment, the straw member 46 may have a length of approximately two feet. The straw member 46 is flexible for facilitating consumption of a beverage from the main bottle portion 38 while the main bottle portion 38 is in an upright position.

In use, a user would use the present invention similarly to a typical baby bottle. A user would insert a disc into the music system providing a soothing tune for allowing the infant to relax during times of feeding.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A musical bottle system for providing aural stimulation while drinking, comprising:

a main housing assembly having a bottom wall, a top wall, and a perimeter wall defining an interior space;

a sound reproduction assembly positioned substantially within said main housing assembly, said sound reproduction assembly being for generating music or vocal signals;

wherein said sound reproduction assembly further includes:

a sound generating means for translating media stored information into an electrical signal representation of an audio signal:

at least one speaker assembly for converting said electrical signal representation into sound waves, said speaker assembly being operationally coupled to said sound generating means; and a battery member for providing electrical energy to said sound generating means, said battery member being operationally coupled to said sound generating means;

wherein said sound generating means comprises a sound generating means selected from the group of sound generating means consisting of compact disc player, mini disc player, mp3 player, or cassette player:

a container portion operationally couplable to said main housing assembly, said container portion being for holding a beverage to be consumed by a user.

2. The system of claim 1, further comprising:

wherein said main housing assembly being substantially cylindrical, said perimeter wall of said main housing assembly having a first surface;

said sound generating means having a plurality of control actuators, each one of said control actuators being positioned on said first surface facilitating access by a user;

said main housing assembly having a media slot for selectively receiving prerecorded media to be played by said sound generating means.

3. The system of claim 1, wherein said container portion further comprises:

a main bottle portion adapted for holding a beverage, said main bottle portion having a bottom wall and a bottle perimeter wall extending upwardly there from, said perimeter wall having a distal end with thread applied thereon;

a cap member having a medial aperture extending therethrough, said cap member being threadedly couplable to said main bottle portion;

a nipple member operationally couplable to said cap member, said nipple member being for facilitating drinking by an infant.

4. The system of claim 3, wherein said container portion further comprises:

a straw member having a first end positionable substantially within said main bottle portion, said straw member having a second end extending through said medial aperture, said straw member being substantially hollow;

said nipple member being coupled to said straw member, such that said nipple member being in environmental communication with an interior of said main bottle portion.

5. The system of claim 4, wherein said straw member having a length of approximately two feet, said straw member being flexible for facilitating consumption of a beverage from said main bottle portion while said main bottle portion being in an upright position.

6. A musical bottle system for providing aural stimulation while drinking, comprising:

a main housing assembly having a bottom wall, a top wall, and a perimeter wall defining an interior space;

a sound reproduction assembly positioned substantially within said main housing assembly, said sound reproduction assembly being for generating music or vocal signals;

a container portion operationally couplable to said main housing assembly, said container portion being for holding a beverage to be consumed by a user;

wherein said sound reproduction assembly further comprises:

a sound generating means for translating media stored information into an electrical signal representation of an audio signal;

at least one speaker assembly for converting said electrical signal representation into sound waves, said speaker assembly being operationally coupled to said sound generating means; and a battery member for providing electrical energy to said sound generating means, said battery member being operationally coupled to said sound generating means;

wherein said sound generating means comprises a sound generating means selected from the group of sound generating means consisting of compact disc player, mini disc player, mp3 player, or cassette player;

wherein said main housing assembly being substantially cylindrical, said perimeter wall of said main housing assembly having a first surface;

said sound generating means having a plurality of control actuators, each one of said control actuators being positioned on said first surface facilitating access by a user;

said main housing assembly having a media slot for selectively receiving prerecorded media to be played by said sound generating means;

wherein said container portion further comprises:

a main bottle portion adapted for holding a beverage, said main bottle portion having a bottom wall and a bottle perimeter wall extending upwardly there from, said perimeter wall having a distal end with thread applied thereon;

a cap member having a medial aperture extending therethrough, said cap member being threadedly couplable to said main bottle portion;

a nipple member operationally couplable to said cap member, said nipple member being for facilitating drinking by an infant;

wherein a straw member having a first end positionable substantially within said main bottle portion, said straw member having a second end extending through said medial aperture, said straw member being substantially hollow;

said nipple member being coupled to said straw member, such that said nipple member being in environmental communication with an interior of said main bottle portion; and wherein said straw member having a length of approximately two feet, said straw member being flexible for facilitating consumption of a beverage from said main bottle portion while said main bottle portion being in an upright position.

* * * * *